United States Patent [19]

Selhofer

[11] 4,068,580

[45] Jan. 17, 1978

[54] SELECTIVE DUPLICATING MACHINE

[75] Inventor: Henri Othmar Selhofer, Geneva, Switzerland

[73] Assignee: Scriptomatic, Inc., Philadelphia, Pa.

[21] Appl. No.: 717,085

[22] Filed: Aug. 24, 1976

[51] Int. Cl.[2] ..... B41L 47/46

[52] U.S. Cl. ..... 101/53; 101/132.5

[58] Field of Search ..... 101/47, 48, 49, 53, 101/55, 58, 62, 118, 132, 132.5, 133, 134.5

[56] References Cited

U.S. PATENT DOCUMENTS

| | | | |
|---|---|---|---|
| 3,547,027 | 12/1970 | Gombault | 101/132.5 X |
| 3,581,658 | 6/1971 | Shepherd | 101/132 |
| 3,603,253 | 9/1971 | Tonkin et al. | 101/142 |
| 3,640,215 | 2/1972 | Shepherd | 101/53 |
| 3,807,303 | 4/1974 | Petersen | 101/132.5 |
| 3,996,854 | 12/1976 | Shepherd | 101/53 X |

FOREIGN PATENT DOCUMENTS

| | | | |
|---|---|---|---|
| 1,230,466 | 5/1971 | United Kingdom | 101/47 |

*Primary Examiner*—Edward M. Coven
*Attorney, Agent, or Firm*—John W. Logan, Jr.

[57] ABSTRACT

A duplicating machine for duplicating printed material from selected master cards onto a workpiece comprises a master card feed station including a feed device for feeding cards to a print station and a workpiece feed station including a device for feeding workpieces to a moistening apparatus and to the print station. Also provided is a card reading device for detecting predetermined information characteristics stored on an adjacent master card in a stack and for determining whether the printed material on that card is to be duplicated. If the material is to be duplicated the reading device provides a signal to a control system that actuates the workpiece feed device for feeding the workpiece to the print station. As the workpiece is fed from its feed station, it actuates an envelope feed detector which provides a signal that operates a common drive arrangement that actuates the moistening apparatus and the master card feed device whereby the master card and a moistened workpiece arrive at the print station for duplicating the printed material from the master card onto the workpiece. If the printed material on the card being read is not to be duplicated, the reading device provides another signal that operates the common drive arrangement so that only the master card is fed to the print station whereby the printed material is not duplicated.

28 Claims, 12 Drawing Figures

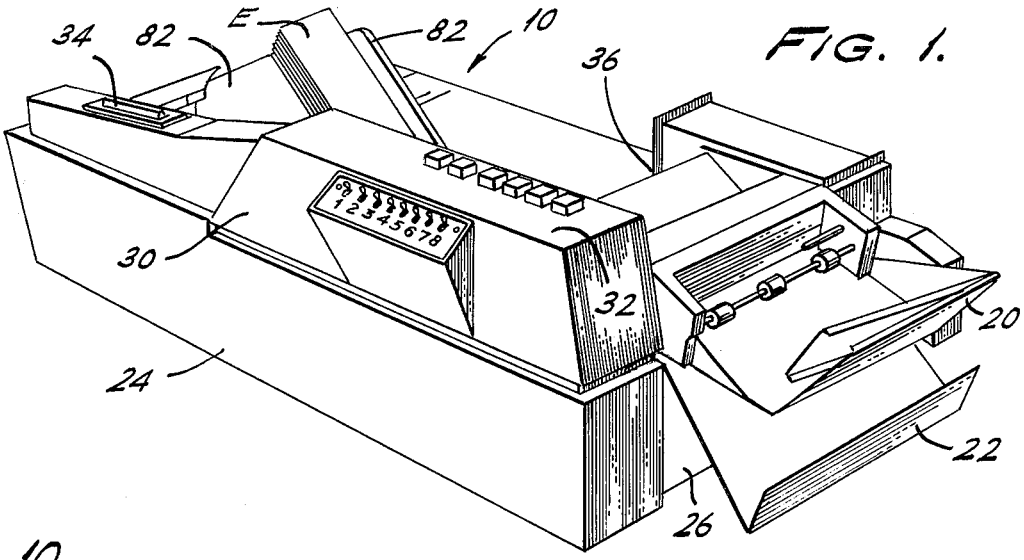
FIG. 1.
FIG. 10.
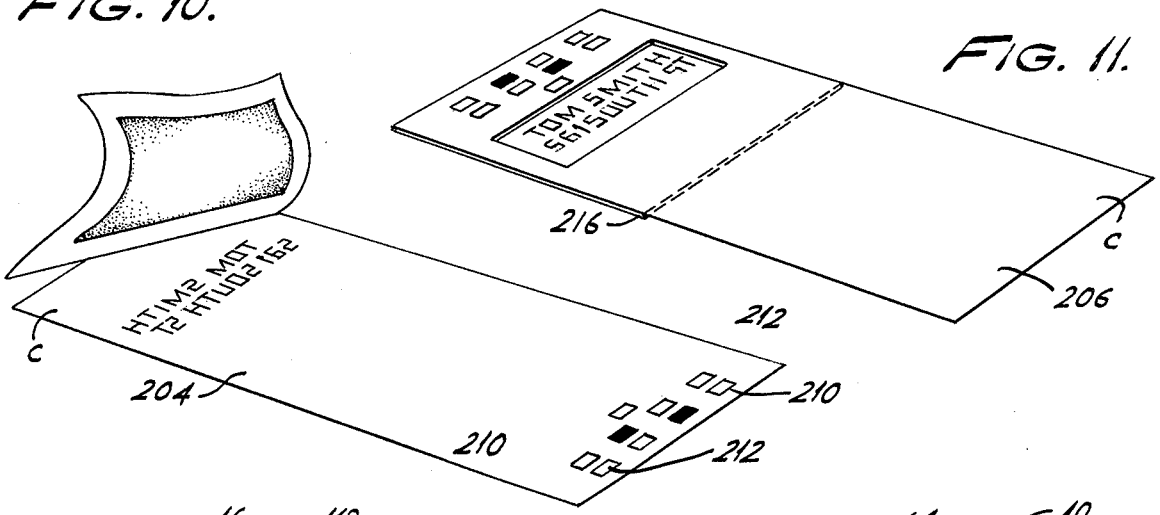
FIG. 11.
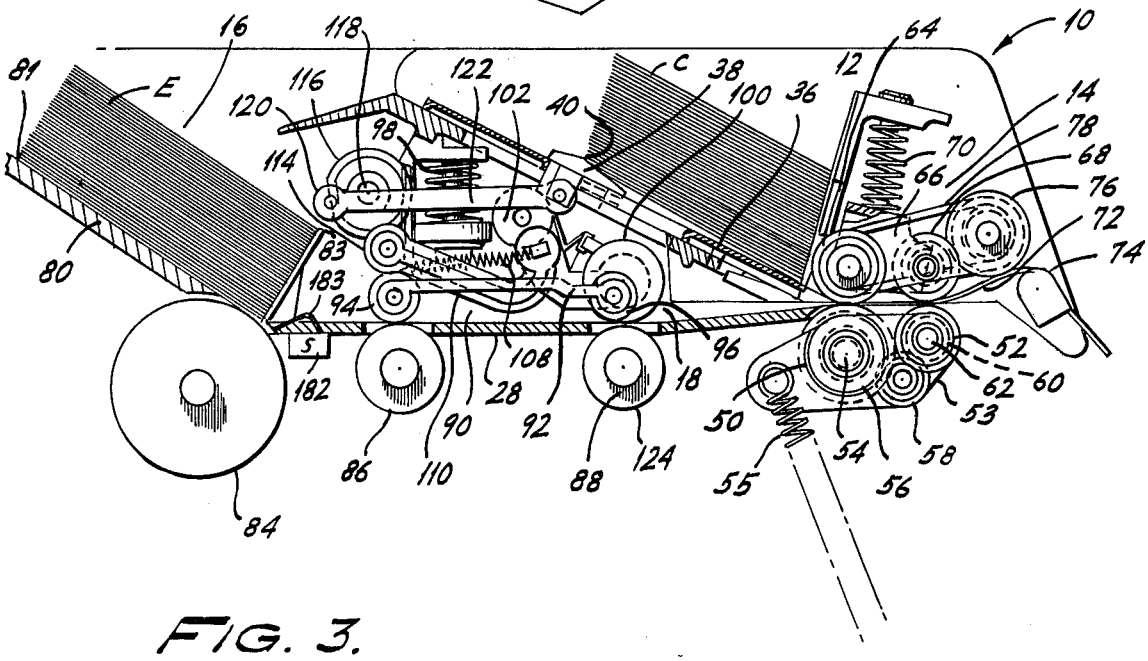
FIG. 3.

SELECTIVE DUPLICATING MACHINE

This invention relates to duplicating machines and, more particularly, to relatively inexpensive duplicating machines usable to selectively duplicate printed material from a master card onto a workpiece in accordance with information stored on the card.

Certain relatively inexpensive duplicating systems are known for reproducing printed material and which are particularly useful for reproducing discrete data onto individual workpieces. As an example, these systems are particularly useful for reproducing addresses on envelopes. Many of these systems operate in accordance with a hectograph technique and utilize a master card on which the address is printed and stored in a form allowing for its reproduction on envelopes. The master cards each storing a different address are placed in a stack and are fed through a duplicating machine including master card feeding apparatus and envelope feeding apparatus and a moistening means all arranged such that the envelope is moistened in a predetermined area and the master card and moistened envelope are fed through a print station simultaneously. At the print station the moistened area of the envelope is pressed into engagement with the address stored on the master card so that the address is duplicated on the envelope. Both the master card and the envelope are discharged from the print station into separate receiving areas, the cards for reuse and the envelope for mailing.

While systems of the type described above work very well, it is noted that it is often desired to reproduce the printed material from only selected cards in a stack. For example, if, as described above, the master cards have addresses stored thereon, all of the master cards can be construed to comprise a general mailing list. When it is desired to send a special mailing to only those individuals on the general mailing list having certain characteristics, for example, only individuals who have purchased a predetermined amount or who live in a particular geographic area, it has been found necessary to sort the cards manually selecting those cards having the desired characteristics and forming a new stack from the selected cards. This new stack is then fed to the duplicating machine described above. Obviously, manual sorting of the cards is time consuming and expensive. In the alternative, separate mailing lists may be maintained by maintaining separate stacks of cards, one corresponding to the general mailing list and the other corresponding to anticipated special mailing lists. This technique is not entirely foolproof since unanticipated mailing lists can arise. Further, this technique reults in maintaining the same address in duplicate and is, therefore, somewhat expensive.

Accordingly, it is an object of this invention to provide a relatively inexpensive duplicating machine usable to duplicate printed material from selected master cards onto a workpiece.

It is another object of this invention to provide a duplicating machine including reader means for reading information stored on a master card containing printed material to be transferred to a workpiece and which further includes control means responsive to said reader means for operating the machine in one mode to duplicate the printed material if predetermined information is detected and in another mode if predetermined information is not detected.

It is yet another object of this invention to provide a duplicating machine including master card feed means and workpiece feed means for feeding master cards and workpieces to a print station and further including mechanical means for adjusting the location of the printed material transferred from the card onto the workpiece.

Finally, it is an object of this invention to provide a duplicating machine usable to duplicate printed material from selected master cards on a workpiece and which is rugged, economical and easy to use.

These and other objects of this invention can be accomplished by providing a duplicating machine usable with master cards containing printed material to be duplicated on a workpiece and information relating to various characteristics of the printed material. The machine includes a master card feed station including means for feeding master cards to a print station and a workpiece feed station including means for feeding workpieces to the print station. Between the master card feed station and the workpiece feed station is a moistening means for applying solvent to the workpiece. The moistening means is operatively connected to a drive member to which the master card feed means is also operatively connected so that each time a master card is fed to the print station, the moistening means is moved from an inoperative to an operative position where it can apply the solvent to the workpiece. At the master card feed station there is provided card reader means for reading the information on an adjacent card before it is fed to the print station and for providing output signals indicating that predetermined characteristics have or have not been detected. There is also provided control means responsive to the signals from the reader means for operating the drive member thereby feeding a master card to the print station and moving the moistening means to an operative position and for also feeding a workpiece to the print station if the printed material is to be duplicated or for operating the drive member only whereby only the master card is fed to the print station if the printed material is not duplicated. Preferably, the moistening means is arranged so that although it is in the operative position when only the master card is fed to the print station, the moistening means is operative in response to the feeding of a workpiece.

The machine also preferably includes mechanical adjustable time delay means for operating the drive member at a predetermined time after the feeding of the workpiece is initiated so that the relative position of the card and the workpiece at the print station can be adjusted to adjust the location of the printed material on the workpiece. The control means is preferably arranged to operate in two modes. In one mode the control means provides for duplication of the printed material if predetermined information characteristics are detected and in the other mode if predetermined information characteristics are not detected.

For a better understanding of the invention reference is made to the following description of a preferred embodiment thereof taken in conjunction with the figures of the accompanying drawing, in which:

FIG. 1 is a perspective view of a duplicating machine in accordance with this invention;

FIG. 3 is a side elevation view taken along line 3—3 of FIG. 2;

FIGS. 10 and 11 are perspective views illustrating the imprint and reverse faces, respectively, of a master card usable with a machine in accordance with this invention; and, FIG. 12 is a schematic diagram of a circuit associated with the reader means and the control means usable with a machine in accordance with this invention.

Figure 2:
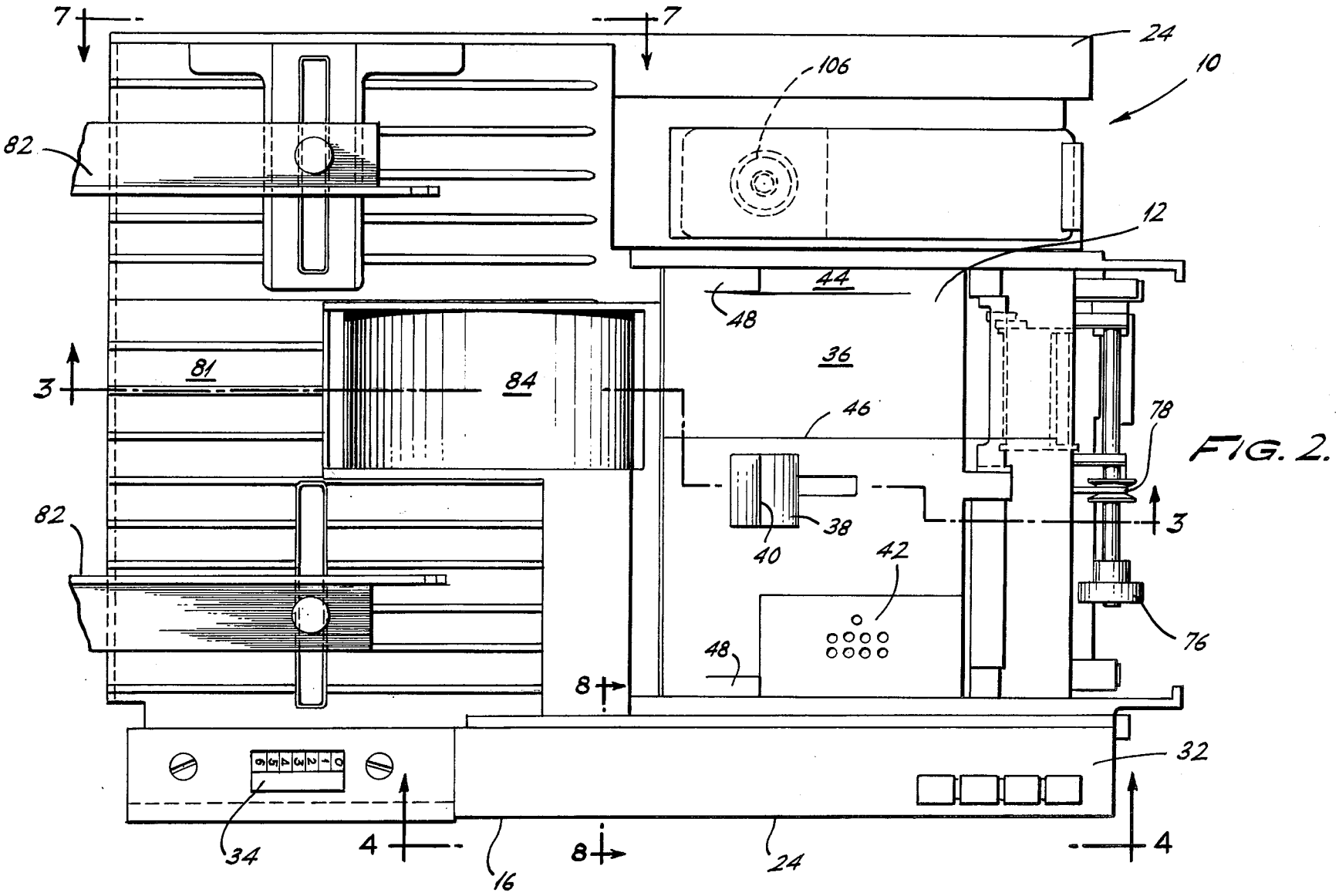
FIG. 2 is a plan view of a portion of the machine illustrated in FIG. 1 with a portion thereof broken away for the sake of clarity.

Referring to the various figures of the drawing, there is shown a duplicating machine 10 in accordance with this invention which is particularly adapted to duplicate addresses from a master card C on an envelope E. It should be noted at the outset that other types of printed material can be contained on the master card and can be duplicated on workpieces other than envelopes. For the sake of consistency, the terms addresses and envelopes will be used in the remainder of the specification. The duplicating machine 10 includes a master card feed station 12 including means for feeding individual master cards C from a stack of such cards to a print station 14 and also includes an envelope feed station 16 including means for feeding individual envelopes from a stack to the print station. Between the print station 14 and the envelope feed station 16, there is provided moistening means 18 for applying a solvent to the envelope at an area on which the address is to be duplicated. At the discharge of the print station 14 is a card receiving tray 20 in which cards are stacked when discharged from the print station and also an envelope receiving tray 22 into which the envelopes are discharged from the print station.

Before proceeding with a further description of the various apparatus, a brief description of the support housing is provided. The master card feed station 12, the print station 14, the envelope feed station 16 and the moistening means 18 are located in a housing including a pair of sidewall assemblies 24, 24 and a pair of end wall assemblies 26, 26 of lesser height than the sidewall assemblies and arranged to form a generally rectangular box-like structure. Intermediate the top and bottom edges of the sidewall assemblies 24, 24 and the end wall assemblies 26, 26 is a deck plate 28 located generally along the path of travel of an envelope through the machine, as best seen in FIG. 3 of the drawing. One of the sidewall assemblies includes a removably mounted cover member 30 forming a closed space for various parts of the apparatus and which receives various switches to form a control panel 32 for selecting the desired operational mode of the machine. A counter device 34 of any conventional type for counting the number of envelopes printed is arranged to be visible through an opening in the sidewall assembly.

Figure 5:
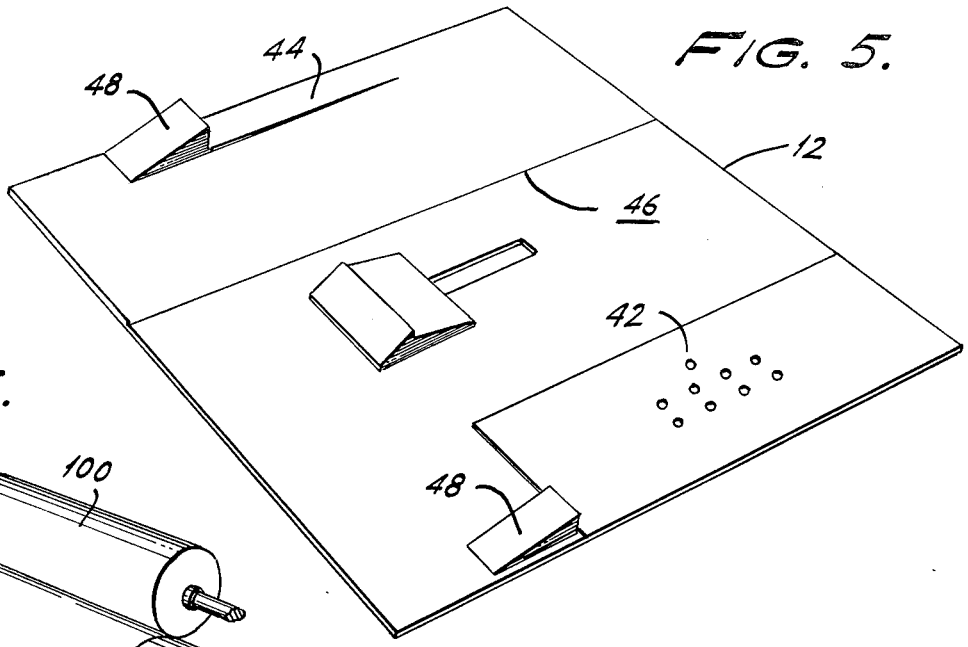
FIG. 5 is a perspective view of the top surface of the master card feed station.

The master card feed station 12 includes an inclined tray 36 in which a stack of master cards C may be placed for feeding to the print station 14. At the bottom inclined surface of the tray 34 is a picker plate 38 arranged to be driven back and forth adjacent the face of the bottom card in the stack. The picker plate 38 is formed with a small shoulder 40 which engages the trailing edge of the bottom card in this stack and forces this card from the stack to the print station 14 through a slot at the juncture of the bottom inclined surface and the generally upright inclined surface. Also located at the lower end of the tray 36 is card reading means 42 best seen in FIGS. 2 and 5 of the drawing. For purposes of clarity, it is merely noted at this point that the card reading means 42 is operative to read information stored on the exposed face of the bottom card C in the stack and to provide output signals to a control circuit which then controls the operation of the duplicating machine 10. The bottom inclined surface of the card tray 36 is formed with a cutout portion in which the card reading means 42 is located and the top surface of the card reading means 42 projects just slightly above the bottom inclined surface so as to be generally level with a lift surface 44 located at the opposite side of the card tray from the card reading means. In addition, the rib 46 is formed on the bottom inclined surface of the card tray 36 and extends to the same level as the lift surface 44 and the top surface of the card reading means 42 and is located intermediate the lift surface and the card reading means so that the bottom card in the stack is spaced slightly from the bottom inclined surface of the tray. The spacing is such that the shoulder 40 on the picker plate 38 engages the trailing edge of the bottom card. Preferably, as seen in FIG. 5 of the drawing the top surface of the card reading means 42, the lift surface 44 and the rib 46 taper downwardly and are level with the bottom inclined surface of the card tray 36 adjacent the slot so as to facilitate ejection of the bottom card from the tray. A pair of guide members 48, 48 are formed adjacent the upper end of the bottom inclined surface of the card tray 36 and function to locate the cards on the tray so that information areas on the card are properly aligned relative to the individual reading mechanisms in the card reading means 42.

From the master card feed station 12, the card is discharged to the print station 14 which is generally similar to that disclosed in U.S. Pat. No. 3,581,658 issued June 1, 1971 to Robert A. Shepherd, Sr. The disclosure of the Shepherd patent is incorporated herein by reference. As seen in FIG. 3 of the drawing the print station 14 includes a pair of feed rollers 50 and 52, the latter carried by a cradle 53. The feed roller 50 is arranged such that a small arcuate segment is located above the deck plate 28 and the cradle 53 is biased by a spring 55 such that a small arcuate segment of the roller 52 is located above the deck plate. The roller 50 is fixedly carried on a shaft 54 which also fixedly carries a gear member 56 in meshing engagement with an idler gear member 58 carried on the cradle 53. In turn the idler gear member 58 is in meshing engagement with a gear member 60 fixedly carried on a shaft 62 on which the feed roller 52 is fixedly carried. As will be explained later the shaft 54 is positively driven during operation of the duplicating machine 10 and accordingly, so is the feed roller 50. Because of the arrangement of gear members 56, 58 and 60, the feed roller 52 is also positively driven in unison with the feed roller 50. Located above the feed roller 50 is a print roller 64 rotatably carried in a cradle 66 which also rotatably carries a print roller 68, the latter being located above the feed roller 52. A compression spring member 70 biases the cradle such that the print rollers 64 and 68 are in pressure-applying engagement with the feed rollers 50 and 52, respectively. Thus, when a master card and an envelope pass between the nip of the print and feed rollers at the print station, pressure is applied and the image on the master card is duplicated on the envelope in accordance with known hectographic or other duplicating techniques. A pair of belt members 72, only one of which can be seen in FIG. 3 of the drawing, extend from the lower end of the card tray 36 to an arcuate surface 74 located at the discharge of the duplicating machine 10. As the master card and envelope travel through the print station, the master card rides along the upper surfaces of the belt members 72 and the envelope rides along the lower surfaces of the belt members so that the master card is discharged to the card receiving tray 20 and the envelope to the envelope receiving tray 22. A plurality of discharge feed rollers 76 are located adjacent the arcuate surface 74 and are positively driven by a belt 78 from the shaft on which the print roller 64 is carried so that the cards are positively driven from the print station to the tray 20.

Figure 4:
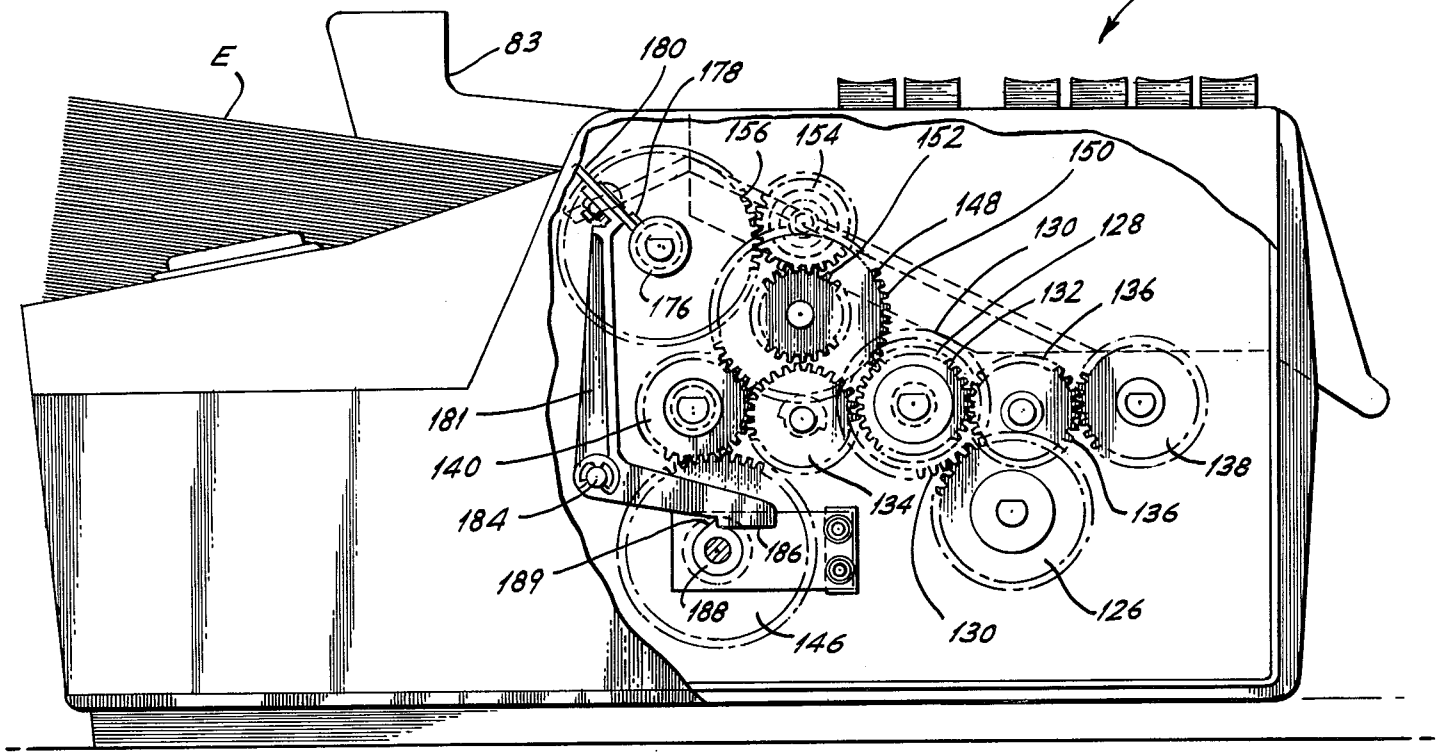
FIG. 4 is a sectional view taken along the line 4—4 of FIG. 2.
Figure 7:
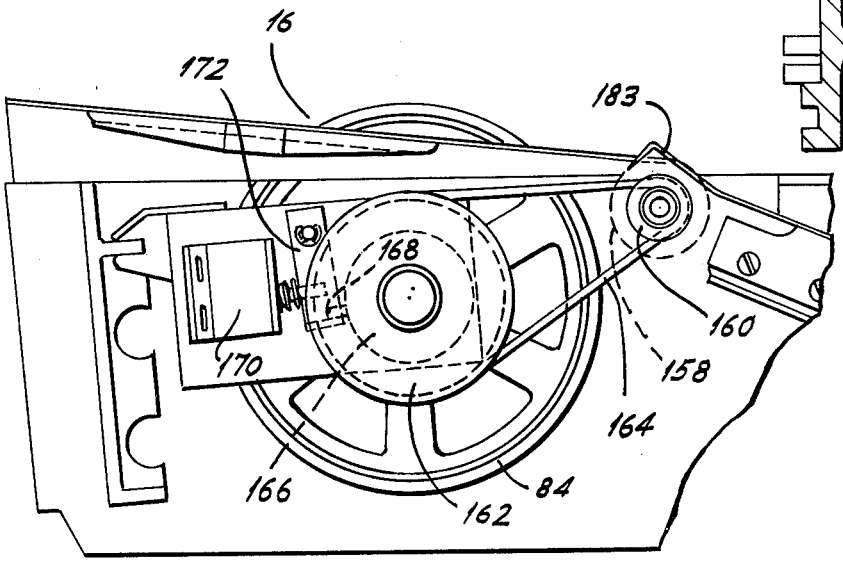
FIG. 7 is a side elevation view taken along the line 7—7 of FIG. 2.

As best seen in FIGS. 1, 4 and 7 the envelope feed station 16 includes an inclined envelope tray 80 including an inclined bottom surface 81 on which the envelopes rest, a pair of sidewalls 82, 82 which retain the envelopes on the inclined surface and a generally upright surface 83 against which the envelopes bear. The sidewalls 82, 82 are adjustably mounted on the bottom surface 81 through a slot and setscrew arrangement to accomodate envelopes of varying sizes. Located below the deck plate 28 and just forward along the path of travel of the envelope of the tray 80 is a feed roller 84 preferably having a rubber outer periphery which engages the bottom envelope in a stack and discharges it forwardly through the duplicating machine to a feed roller 86 which extends upwardly through the deck plate 28 and which drives the envelope to the moistening means 18. The arrangement of the feed roller 86, the mositening means 18 and the drive for the picker plate 38 is similar in certain respects to that disclosed in U.S. Pat. No. 3,807,303 issued on Apr. 30, 1974 to Eric Rickard Petersen. The disclosure of the Petersen patent is incorporated herein by reference.

Included in the moistening means is another feed roller 88 which also extends upwardly through the deck plate 28. Both the feed rollers 86 and 88 are positively driven, as will be explained hereinafter, to drive the envelope from the envelope feed station 16 through the moistening means 18 and to the print station 14. A nip roller unit 90 is associated with both the feed rollers 86 and 88 to direct the envelope into the machine along a straight predetermined path through the moistening means 18 and the print station 14. As best seen in FIG. 3, the nip roll unit 90 includes a frame member 92 which, although not illustrated, has an H-shape in plan view. At one end, the frame member 92 carries a plurality of nip rollers 94 located above the feed roller 86 and at the other end carries another plurality of nip rollers 96 located above the feed roller 88. A compression spring 98 is connected to the underside of the inclined bottom surface of the card tray 36 and on the cross-leg of the frame member 92 to hold the plurality of nip rollers in pressure-applying engagement with the feed rollers. With this arrangement, the nip rollers 94 and 96 can move vertically over thickened or uneven portions of the envelope without disturbing the longitudinal alignment of the nip roll unit 90 thereby providing a positive straight line feed for each envelope.

Further included in the moistening means is a moistening roller 100 rotatably mounted in a yoke 102 and located above the feed roller 88. The yoke 102 is a bent frame member pivotally mounted at one end to the underside of the inclined bottom surface of the card tray 36 and rotatably carrying the moistening roller 100 at its other end. A wick member 104 is maintained in engagement with an upper surface portion of the moistening roller 100 and connects to a solvent bottle 106 so that the solvent is applied to the surface of the moistening roller at a top segment thereof as seen in the drawing. A spring member 108 is connected at one end to the yoke 102 and at its other end to a pin extending downwardly from the underside of the card tray 36 and is operative to bias the moistening roller 100 downwardly into engagement with the feed roller 88. However, the moistening roller 100 is prevented from engaging the feed roller 88 by an arm member 110 keyed to a pin extending from the yoke 102 intermediate its ends. At its other end the arm member 110 carries a cam follower 114 which is urged by the spring member 108 into engagement with a cam 116 normally carried on a driven shaft 118 for rotation therewith. The configuration of the cam 116 is such that in one position of the cam and the driven shaft 118, the spring member 108 cannot urge the moistening roller 100 into engagement with the feed roller 88; when the cam rotates to different positions with the driven shaft, the spring member 108 can now bias the moistening roller 100 into engagement with the feed roller 88.

At this point, it is noted that the cam 116 carries a pin 120 so that the pin rotates with the cam. A link 122 is connected to the pin 120 at one of its ends and is connected to the picker plate 38 at its other end so that as the cam rotates with the driven shaft 118, the link 122 drives the picker plate back and forth along the inclined bottom surface of the card tray 36 to feed a single card to the print station as previously described. If desired the cam 116 can be constructed and arranged with an adjusting device in accordance with the above referenced Petersen patent to change the position of the duplicated material on the envelope but this is not necessary in view of the adjusting means to be described later in this application and the use of which is preferred in this invention.

Figure 6:
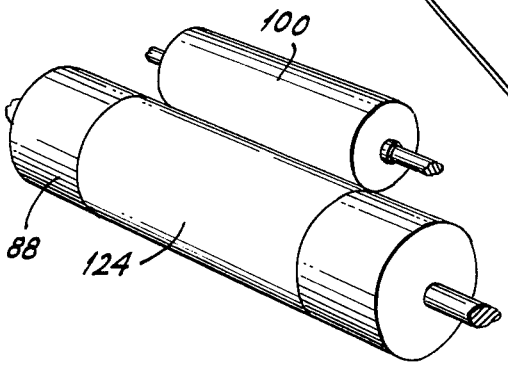
FIG. 6 is a perspective view of the moistening roller and its associated feed roller.

As should now be understood, for each revolution of the driven shaft 118 and the cam 116, the moistening roller 100 is biased downwardly toward the feed roller 88 and the picker plate 38 is operative to eject a card from the card feeding station 12 to the print station 14. As will be made clear hereinafter, the duplicating machine 10 includes means for detecting predetermined information on the bottom card C in the stack and for determining whether the bottom card is to be duplicated or not. Operation of the machine is such if the bottom card in the stack is to be duplicated both the card and an envelope are fed through the print station; if the bottom card is not to be duplicated, only the card is discharged but an envelope is not. Of course, since no envelope is discharged, no duplication can occur. At this point it is noted that with the above described arrangement whereby the moistening roller 100 is biased downwardly each time the picker plate 38 is operative to feed a card, solvent would be wasted each time the moistening roller 100 is driven by the feed roller 88 when no envelope is fed to the print station 14. That is, each time the feed roller 88 and the moistening roller 100 were engaged the feed roller would drive the moistening roller so that solvent would be distributed on the feed roller. In addition to wasting solvent, an excessive amount of solvent could be applied to the envelope first fed to the print station 14 following a series of cards which are not to be duplicated. To prevent the above problem, as best seen in FIG. 6 of the drawing, a sleeve member 124 having an inner diameter just slightly larger than the outer diameter of the feed roller 88 is carried on the feed roller so that the feed roller is rotatable relative to the sleeve member. Further, the sleeve member 124 has an axial length slightly greater than that of the moistening roller 100 and is located in registry with the moistening roller. Thus, when the moistening roller 100 is biased toward the feed roller 88 it is in pressure-applying engagement with the sleeve member 124 and if no envelope is present, the feed roller 88 simply rotates within the sleeve member 124 which remains stationary. Thus, the moistening roller 100 is not rotated and no solvent is distributed on the surface of the sleeve member 124. On the other hand, if an envelope is fed from the envelope feed station 16, as the envelope passed between the nip of the moistening roller 100 and the sleeve member 124 it exerts sufficient force on the sleeve member to in effect engage the sleeve member with the feed roller 88 causing the sleeve member to rotate with the feed roller. In addition, the envelope causes rotation of the moistening roller 100 causing the moistening roller to apply the solvent to the envelope. Accordingly, a relatively inexpensive arrangement is provided for applying solvent only when an envelope is present.

Figure 8:
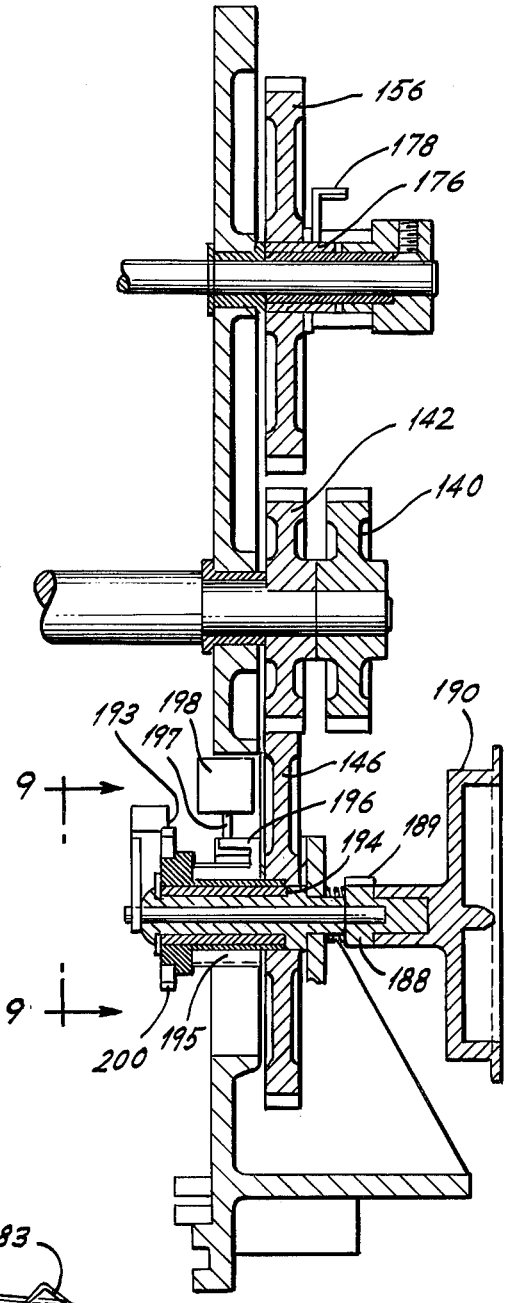
FIG. 8 is a sectional view taken along the line 8—8 of FIG. 2.

Referring to FIG. 4 of the drawing, the drive arrangement for the master card feed station 12, print station 14, and the moistening means 18 will now be explained. Now shown on the drawing, but located beneath the deck plate 28 is an electric motor of any suitable type which drives a main output drive gear 126 which drives a compound gear member 128 fixed on the shaft on which the feed roller 88 is fixed so that this feed roller is positively driven. The compound gear member 128 includes a first gear 130 in meshing engagement with the main output drive gear and a second smaller gear 132 formed behind, as viewed in the drawing, the gear 130 and is in driving engagement with a pair of idler gears 134 and 136 located in front of and in back of, along the path of travel of the envelope and card, the smaller gear. The idler gear 136 drives a gear 138 which is carried on the shaft 54 for driving the feed roller 50 and the gear member 56 which as explained previously, drives the feed roller 52 through the idler gear member 58 and the gear member 60 and the discharge feed roller 76 through the belt 78. The idler gear 134 drives a pair of gears 140 and 142 which are fixed on the shaft on which the feed roller 86 is fixed so that this feed roller is positively driven. As best seen in FIG. 8 of the drawing the gears 140 and 142 are about generally the same size and gear 140 is located in front of the gear 142. The gear 134 meshes with and drives the gear 142 and a timing gear 146 the purpose of which will be explained hereinafter. The gear 140 is in meshing engagement with and drives a compound gear member 148, being in driving engagement with a first gear 150 of the compound gear member. The second gear 152 of the compound gear member 148 meshes with and drives an idler gear 154 which in turn meshes with and drives a gear 156 fixed to the shaft 118 on which the cam 116 is fixed to operate the moistening roller 100 and the picker plate 38 as previously explained. Thus, it can be seen that the single electric motor driving the main output gear 126 is operative to simultaneously drive the feed rollers 50, 52, 86, 88 and the discharge feed roller 76 and also to operate the moistening roller 100 and the picker plate 38.

Referring to FIG. 7 of the drawing, the feed arrangement for the envelope feed station 16 will now be explained. On the side of the duplicating machine 10 opposite the drive apparatus explained above, there is provided a second electric motor 158 of any suitable type. The output shaft of the motor 158 carries a drive sprocket 160 which drives a second sprocket 162 through a chain 164. The second sprocket 162 is carried on the shaft on which the feed roller 84 is fixed and is arranged to be drivingly engaged or disengaged from the shaft by a generally conventional single revolution clutch 166 of the coil spring type. A free end 168 of the coil spring in the clutch 166 extends outwardly therefrom. Adjacent the clutch 166 is a solenoid 170 that pivotally connects a pivoted finger 172 on the free end of its plunger which engages the free end 168 of the clutch when the solenoid is not energized. Thus, the solenoid keeps the clutch from drivingly connecting the second sprocket 162 to the shaft on which the feed roller 84 is fixed. When the solenoid is energized, the plunger retracts moving the finger 172 out of engagement with the free end 168 of the coil spring in the clutch 166 so that the clutch 166 drivingly connects the second sprocket 162 to the shaft on which the feed roller 84 is fixed. Thus the feed roller 84 is rotated and feeds the bottom envelope in the tray 80 to the nip of the feed roller 86 and nip rollers 94. After one revolution of the shaft and, of course, the feed roller 84, the free end 165 of the coil spring in the clutch 166 again engages the finger 172 on the solenoid 170 disconnecting the second sprocket 162 from the shaft. When the solenoid 170 is energized again, the feed process repeats. As an envelope is fed by the feed roller 84 it passes over an envelope feed detector 182 that provides a signal in the associated control circuit indicating that an envelope is being fed to the machine. The envelope feed detector 182 is located between the feed rollers 84 and 86 and is preferably a switch with a spring urged arm 183 extending upwardly in the path of travel of the envelope. When an envelope is fed it depresses the arm 183 and closes a circuit to provide an electrical signal.

The various rollers 50, 52, 76, 86 and 88 are continuously driven by the output of the motor, but as will now be made clear the picker plate 38 and moistening roller 100 are driven intermittently. Referring to FIG. 4 of the drawing it can be seen that the gear 156 is arranged to be operatively connected or disconnected to the driven shaft 118 by a generally conventional single-revolution clutch 176 again of the coil spring type. Extending from the clutch 176 is the free end 178 of the coil spring and adjacent the free end of the coil spring is a finger 180 located on one end of a generally L-shaped trip arm 181. The trip arm is pivoted at 184 to the frame member and is normally arranged such that the finger 180 normally engages the free end 178 of the coil spring in the clutch 176 so that the gear 156 is operatively disconnected from the shaft 118. Accordingly, in this position the shaft 118 does not rotate and the picker plate 38 and moistening roller 100 are inoperative. For releasing the free end 178 of the coil spring in the clutch 176 and operatively connecting the gear 156 to the driven shaft 118 the other leg portion of the trip arm 181 is formed with a bearing surface 186 located adjacent a cam 188. The cam 188 is formed with a cam finger 189 and is arranged to be operatively connected and disconnected for rotation with the timing gear 146. In addition the position of the finger 189 relative to the bearing surface 186 is adjustable. Thus when the cam 188 rotates the cam finger 189 engages the bearing surface 186 which pivots the trip arm 181 about the pivot 184 in a generally counterclockwise direction as viewed in FIG. 3 of the drawing. As the trip arm 181 pivots; the finger 180 is disengaged from the free end 178 of the coil spring in the clutch 176 whereby the gear 156 is operatively connected to drive the shaft 118 and the cam 116 which as explained previously, operates the picker plate 38 and moistening roller 100. By varying the location of the cam finger 189 relative to the bearing surface 186 the feed of the card and operation of the moistening means 18 relative to the feed of the envelope can be adjusted so that the location of the duplicated material on the card can be adjusted.

Figure 9:
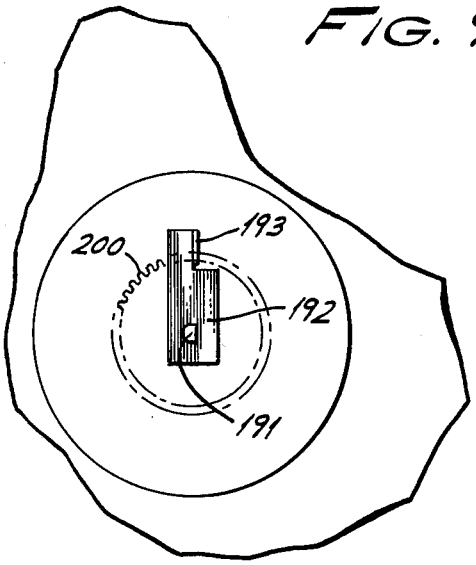
FIG. 9 is an elevation view looking along the line 9—9 of FIG. 8.

Referring now to FIGS. 8 and 9 of the drawing, the preferred arrangement of the cam 188 will be explained. The cam 188 is fixed to an adjusting knob 190 and both the cam and the adjusting knob are fixed to one end of a shaft 191. At its other end the shaft 191 fixedly carries an arm 192 having a narrow extending finger 193. The shaft 191 is received in a sleeve 194 on which the timing gear 146 is carried and arranged to be drivingly connected to or disconnected from by a generally conventional single revolution clutch 195 of the coil spring type. Similar to the clutch 176, the clutch 195 includes a coil spring having a free end 196 projecting therefrom. Ajacent the free end 196 of the coil spring is a finger 197 carried on the plunger of a solenoid 198 and which is normally engaged with the free end of the coil spring so that the timing gear 146 rotates on the sleeve 194. When the solenoid 198 is energized the plunger and finger 197 retract and the clutch 195 connects the timing gear 146 to the sleeve 194 so that the sleeve rotates with the timing gear. Rotation of the sleeve 194 is transmitted to the shaft 191 and, of course, to the cam 188 to pivot the trip arm 182 as noted above.

To provide for the adjustment of the cam 188 and of the location of the imprint area on the envelope and to secure the shaft 191 for rotation with the sleeve 194, the sleeve carries a gear member 200 and the finger 193 on the arm 192 is normally received between adjacent teeth to fix its position and also that of the shaft 191 and the cam finger 189 relative to the sleeve 194. A spring 202 normally biases the cam 188 and the adjusting knob 190 outwardly to retain the finger 193 between adjacent teeth. Thus, to adjust the position of the imprint area on an envelope, it is merely necessary to push the adjusting knob inwardly to disengage the finger 193 from adjacent teeth on the gear member 200 and to then rotate the adjusting knob until the cam finger 189 is in the desired position relative to the bearing surface 186 on the trip arm 182. The adjusting knob 190 is released and the finger 193 is again received between adjacent teeth on the gear member 200 fixing the position of the cam finger 189.

At this point, a summary of the operation of the mechanical portions of the duplicating machine 10 will be explained with brief, but clarifying reference to the control circuit. The card reading means 42 reads information stored on the bottom card C in a stack in the tray 36 before that card is fed to the print station 14. The card reading means 42 provides an output signal indicating that predetermined information has or has not been detected on the card. If the address is not to be duplicated, only the card is fed to the print station 14 and is discharged to the card receiving tray 20. Thus, a control circuit operating in response to the signals from the card reading means 42 energizes only the solenoid 198 which will hereinafter be referred to as a card feed solenoid. When the card feed solenoid 198 is energized the timing gear 146 drives the cam 188 through the above described arrangement so that the cam finger 189 pivots the trip arm 181 connecting the gear 156 to the shaft 118. At this point the shaft 118 rotates through one revolution driving the cam 116 through one revolution. As the cam member 116 rotates, the cam follower 114 pivots the arm member 110 and the yoke 102 so that the moistening roller 100 moves downwardly into engagement with the sleeve member 124 on the feed roller 88. As noted previously, since no envelope is fed the moistening roller 100 is not driven by the feed roller 88. Simultaneous with the above movement, the link 122 is driven by the cam 116 so that the picker plate slides downwardly along the bottom surface of the card tray 36 ejecting a card to the nip between the print roller 64 and feed roller 50. Eventually, the card is discharged between the nip between the discharge feed roller 76 and the arc surface 74 to the card receiving tray 20.

If the card reading means 42 determines that the address on the master card being read is to be duplicated, the control circuit energizes the solenoid 170 which will hereinafter be referred to as an envelope feed solenoid. When the envelope feed solenoid 170 is energized the feed roller 84 is rotated through one revolution and feeds an envelope to the nip between the feed roller 86 and nip rollers 94. As the envelope depresses the arm 183 the envelope feed detector activates the control circuit to energize the card feed solenoid 198 which, as noted, causes the picker plate 38 to feed a card to the print station 14 and to urge the moistening roller 100 into engagement with the sleeve member 124. As the envelope passes through the moistening means the moistening roller 100 is driven to apply solvent to the envelope. From the moistening means 18 the envelope is fed to the nip between the feed roller 50 and the print roller 64 which also receives the card. As the card and the envelope are fed through the nip of the feed roller 50 and the print roller 64 and then through the nip between the feed roller 52 and the print roller 68, pressure is applied which duplicates the address on the envelope. From the print station the card is discharged between the nip of the discharge feed roller 76 and the arc surface 74 to the card receiving tray 20 while the envelope is discharged to the envelope receiving tray 22.

Before proceeding with a description of card reading means 42 and a control circuit usable with this invention, a master card usable with the machine 10 will be described. Referring to FIGS. 10 and 11 of the drawing, a master card C is illustrated and is formed of a sheet of paperboard or the like material having an imprint face 204 and a reverse face 206. The imprint face 204 includes a smooth imprint area on which a reverse image of the printed material to be duplicated is stored as seen in FIG. 10 of the drawing. Opposite the imprint area on the reverse face 206 is a recessed area 208 on which a true image of the printed material is initially received. Also included on the imprint face 204 are a plurality of card usage control areas 210 arranged in predetermined positions corresponding to the predetermined positions of individual card reading elements in the card reading means 42. The card usage control areas 210 are light reflective surfaces bounded by indicia 212 to indicate their positions and can be darkened by a pencil or a similar device to provide a generally non-reflective surface shown in two of the card usage control areas. By providing non-reflective surfaces in various of the card usage control areas, information indicative of certain characteristics of the printed material contained on the card can be provided in accordance with a predetermined code. As seen in the drawing, there are two rows of card usage control areas with four such areas being provided in each row. It should be understood, however, that any desired number of rows and any desired number of areas in a row can be provided in accordance with this invention. Directly above the two rows of card usage control areas there is a single such area 210*a* bounded by indicia 212*a* which can function, when darkened, to indicate that the cards behind it in the stack have a different zip code. This arrangement is particularly useful when duplicating addresses on envelopes to provide an indication that the zip code to change whereby an operator can remove the envelopes from the tray 22 to provide a stack of addressed envelopes with the same zip code. The reverse face 206 of the card can include a plurality of information areas 214 and 214*a* arranged in predetermined positions generally corresponding to the predetermined position of the card usage control areas 210 and 210*a* whereby a corresponding record of the information stored on the card can be provided in an area which is generally visible to a machine operator to facilitate the handling of the cards.

A suitable transfer medium such as carbon paper 216 is initially located over the imprint area and can be retained on the card by the use of a suitable adhesive along one edge. In use, the card is inserted into a conventional typewriter and a true image of the printed material is typed in the recessed area 208. As the typewriter characters type the printed material, they press the imprint area against the carbon paper 216 to deposit and store a reverse image on the printed material on the imprint area. Once the printed material has been stored on the card, the transfer medium 216 is removed and can be discarded. A pencil or pen can now be utilized to darken appropriate card usage control areas 210 or 210*a* and corresponding information areas 214 or 214*a* to store information concerning various characteristics of the address or addressee. For a further description of a master card usable with machine 10, reference is made to the co-pending application of Erik R. Petersen, Ser. No. 677,231, filed Apr. 15, 1976 for Master Card for Duplicating Printed Material.

Figure 12:
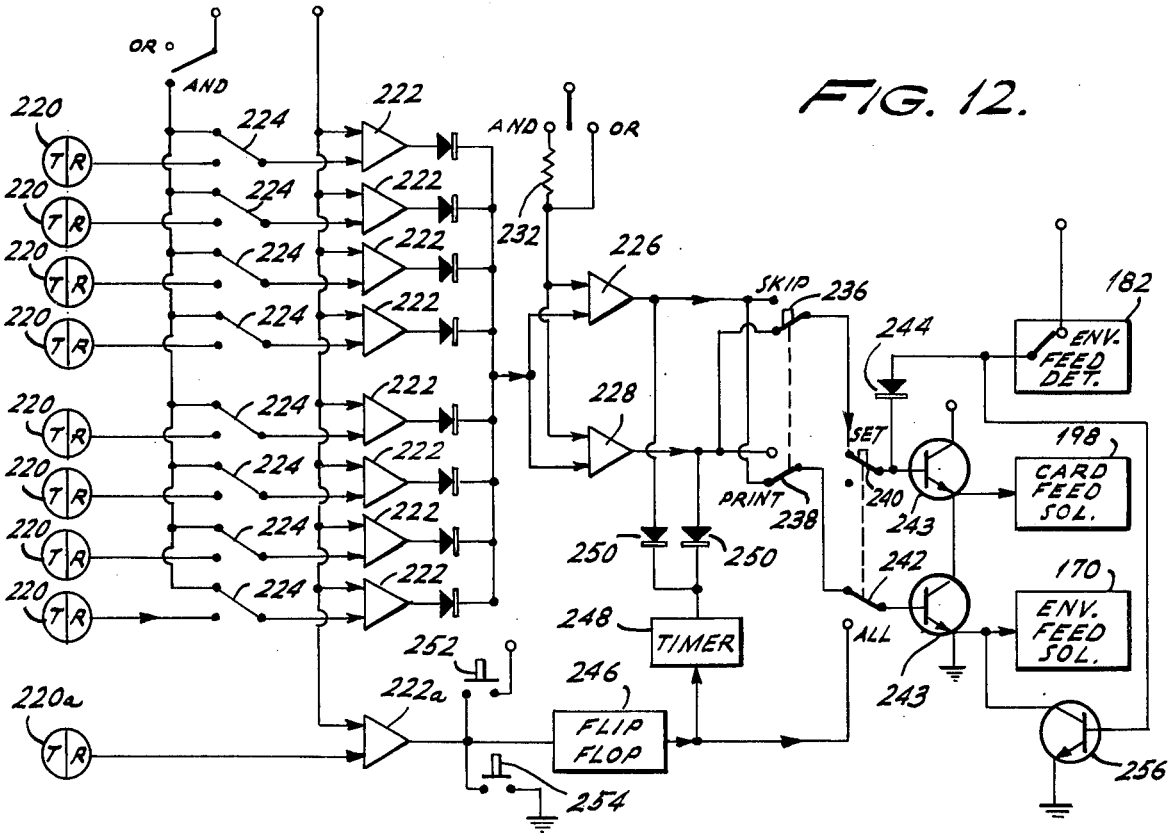

Referring now to FIG. 12 of the drawing, a particular card reading means 42 and control circuit usable with this invention is illustrated. The card reading means 42 includes a plurality of reflected light sensors 220 which can include a light transmitter indicated at T on the drawing such as a light-emitting diode and a phototransistor or some similar device indicated at R on the drawing. For convenience, the reflected light sensors 220 will be referred to as photoelectric cells hereinafter. The photoelectric cells 220 are physically arranged in a pattern corresponding to that of the card usage control areas 210 such that in the card feed station 12 one cell is located adjacent one card usage control area. Thus arranged the transmitter T can direct light onto an individual card usage control area 210 and the receiver R can receive the light which is reflected back from the card usage control area. Further, the photoelectric cells 220 are arranged such that when adjacent card usage control area 210 is not darkened and light is reflected back to the receiver, that is, when information is not contained in the adjacent card usage control area, the output from the cell is a low signal and when an adjacent card usage control area is darkened and light is not reflected back to the receiver, that is, when information is contained in the adjacent card usage control area, the output from the cell is a high signal. Also included is a similar photoelectric cell 220*a* which is physically located adjacent the zip code control area 210*a* and the function of this cell will be made clear hereinafter.

Each of the cells 220 provides its output signal to an associated voltage comparator 222, through an information switch 224 which is in series between each cell and its associated comparator. Each of the voltage comparators 222 also receives a reference signal input from a constant voltage source (not shown) and compares the input signal from the associated photoelectric cell 220 with the reference signal to provide an output signal acceptable to the rest of the logic circuit. The magnitude of the reference signal is such that if no information is contained in the adjacent card control area 210 the output of the voltage comparator 222 is a high signal and if information is contained in the adjacent card usage control area, the output of the voltage comparator is a low signal.

Each series of a photoelectric cell 220, voltage comparator 222 and information switch 224 are connected in parallel to provide a single output signal which, of course, is the combined output of the individual series circuits and comprises the output of the card reading means 42. Small diodes 223 are provided in each series circuit to prevent the individual outputs from interferring with each other. The output signal from the card reading means is fed to a pair of parallel connected voltage comparators 226 and 228 for comparison with a reference signal from a constant voltage source. Depending on the input signal from the card reading means 42, either the voltage comparator 226 or 228 provides a print or skip signal which controls the operation of the machine 10. As will be clearly explained hereinafter, a print signal is operative to feed both an envelope and a master card to the print station and a skip signal is operative to feed only a master card.

The reference signal to the voltage comparators 226 and 228 is supplied through a switch 230 arranged to feed the reference signal through either of two paths so that the card reading means has two modes of operation. The first mode which may be considered an AND mode, is such that the print signal is provided by the comparators 226 and 228 only if all of a plurality of predetermined information characteristics are detected. That is to say, the print signal is provided only if all of the photoelectric cells 220 whose information switches 224 are closed detect appropriate information in their adjacent card usage control areas 210. In the other mode of operation which may be considered an OR mode, the print signal is provided if any one of a plurality of predetermined information characteristics is detected. That is to say, the print signal is provided if any one of the photoelectric cells 220 whose information switch 224 is closed detected appropriate information in its adjacent card usage control area 210.

In the AND mode of operation the arrangement is such that the voltage comparators 226 and 228 must detect, in effect, the presence of information in each card usage control area 190, that is, must detect a dark space in each card usage control area in order to provide a print signal. To accomplish this result the reference signal to the voltage comparators 226 and 228 is fed through the switch 230 and a relatively large resistance 232. In addition the information switches 224 associated with a photoelectric cell 220 disconnected from the card reading circuit are interconnected by the switches 224 and are connected to a voltage source (not shown) by a switch 234. Thus, the external voltage source provides a signal to any voltage comparator 222 not connected to a photoelectric cell 220 which signal is similar to a signal from a photoelectric cell which is detecting a dark area in its adjacent card usage control area 190. Accordingly, the voltage comparators 226 and 228 provide a print signal if each voltage comparator 222 provides a low ouput signal.

In the OR mode of operation the arrangement is such that the voltage comparators 226 and 228 must detect the presence of information in only one card usage control area 190, that is must detect a single dark space in any of the card usage control areas in order to provide a print signal. To accomplish this result the reference signal to the voltage comparators 226 and 228 is fed through the switch 230 and a relatively low resistance (not shown for clarity). In addition the switch 234 disconnects the external voltage source from the switch 224 and voltage comparators 222 not connected to a photoelectric cell 220. Thus, any voltage comparator 222 not connected photoelectric cell 220 receives only a reference signal input in a manner similar to such a comparator connected to a photoelectric cell detecting a light space in its adjacent card usage control area and provides a high output signal. In operation one low signal input to the comparators 226 and 228 can be detected and a print signal provided.

The output of the voltage comparators 226 and 228 are connected to the envelope feed solenoid 170 and the card feed solenoid 198 through an inverter switch means including switches 236 and 238 and also through a selector switch means including switches 240 and 242. Switches 236 and 238 may be a pair of ganged switches as may be switches 240 and 242. In the position illustrated in the drawing the selector switch is set to operate in the selective mode wherein the solenoids 170 and 198 are energized by the output signals from the voltage comparators 226 and 228. If the selector switch is depressed so that the switches 240 and 242 are in the lower positions the voltage comparators 226 and 228 are disconnected and the envelope feed solenoid is controlled by another portion of the circuit to be described hereinafter whereby all the master cards are duplicated. The inverter switch means is operative to selectively control the operation of the machine 10 to duplicate a master card if predetermined information characteristics are detected or to duplicate a master card if predetermined information characteristics are not detected. Thus, with the inverter switch means in the print position illustrated in the drawing the voltage comparator 226 outputs to the envelope solenoid 170 and the voltage comparator 228 outputs to the card feed solenoid 198. If predetermined information is detected the voltage comparator 226 provides the print signal to the envelope feed solenoid 170 feeding an envelope from the envelope feed station 16 as noted previously. If predetermined information is not detected the voltage comparator 228 provides a skip signal to the card feed solenoid 198, feeding a card only from the card feed station 12 and operating the moistening means 18 as noted previously. By moving the inverter switch to the skip position the operation of the machine 10 is reversed. In the skip position the switch 236 connects the voltage comparator 226 to the card feed solenoid 198 and the switch 238 connects the voltage comparator 228 to the envelope feed solenoid 170. If predetermined information is detected the voltage comparator 226 provides a signal to the card feed solenoid so that the card is not duplicated and if predetermined information is not detected the voltage comparator 228 provides a signal to the envelope feed solenoid 170 so that the card is duplicated. Accordingly the print signal is now provided when predetermined information is not detected and a skip signal is provided when predetermined information is detected. From the preceding it can be seen that the circuit logic can be reversed to provide more flexibility in the operation of the machine 10.

At this point it is noted that suitable thyristors 243, 243 should preferably be provided between the selector switches 240, 242 and the solenoids 198, 170, respectively, to convert the relatively weak logic signals to the larger signals required to energize the solenoids. In addition it will be remembered that when the printed material on a master card is to be duplicated the envelope is fed and operates an envelope feed detector 182 which then provides a signal to the card feed solenoid 198. In the drawing a blocking diode 244 is shown to prevent a skip signal from the comparator 226 or 228 from interfering with the envelope feed detector circuit. It is noted while not shown in the drawing that the envelope feed detector connects a voltage source to the card feed solenoid 198 and can operate the counter device 34 for counting the number of envelopes which are addressed.

To assure that the control circuit provides a valid print signal and not a print signal by reading a card in motion a card detector means is provided in the form of the photoelectric cell **220*a* and a voltage comparator 222*a*. The photoelectric cell 220*a* is arranged to provide a high output signal if it detects a dark area in the zip code control area 210*a* or if it detects a card in motion and a low ouput signal if it detects a white area in the zip code control area, that is, the photoelectric cell 220*a* provides a high output signal if a card is in motion and a low output signal if the card is still in the card tray. From the photoelectric cell 220*a* the signal is fed to the voltage comparator 222*a* which also receives the reference signal input being fed to the voltage comparator 222. Similar to voltage comparators 222, the voltage comparator 222*a* provides a low output signal if the input from the photoelectric cell is high and a high output signal if the input from the photoelectric cell 220*a* is low. Thus, the voltage comparator 222*a*** provides a low output signal if the master card is in motion and a high output signal if the master card is still and is not a card indicating the zip code is changing.

The signal from the card detector means is fed to a flip-flop 246 which, in turn, provides an output to power a timer circuit 248 when the output of the card detector means is a high signal indicating that the master card is still and in motion. The outputs of the voltage comparators 226 and 228 are connected to the timer circuit 248 through blocking diodes 250, 250 and these comparators cannot output to the timer circuit when the timer circuit is powered by the flip-flop. Thus, the output of the voltage comparators 226 and 228 are fed to the appropriate solenoid 170 or 198 when a card is still. This assures that the card reading means 42 is reading a card at rest, not a card in motion. However when the card is in motion the output of the flip-flop 246 is insufficient to power the timer circuit 248 and the voltage comparators 226 and 228 feed their output to the timer circuit so that any signal provided by a card in motion cannot energize the solenoids 170 or 198. The flip-flop 246 also provides an output to the envelope feed solenoid 170 through the suitable switch 242 when the selector switch is in the all mode position. Accordingly, the flip-flop energizes the envelope feed solenoid 170 when the machine is to duplicate the address on each master card.

The voltage comparator 202*a* is arranged to provide a high signal which is insufficient to power the timer circuit 248, but the signal is reinforced by an external voltage source (not shown) when a switch 252 is closed. Once the signal is reinforced the flip-flop 246 maintains the signal at an acceptable level. Thus the switch 252 need only be momentarily closed when the machine 10 is first turned on. Also provided is a switch 254 which will ground the signal from the voltage comparator 202*a* when it is closed. When the switch 254 is momentarily closed, the signal from the comparator 202*a* is returned to the magnitude insufficient to power the timer circuit 248 through the flip-flop. The particular operation cycle of the machine 10 continues to completion and no new cycle can be initiated, but the various electric motors and other electronic functions are still powered. When it is desired to operate the machine again, the switch 252 is depressed reinforcing the signal from the voltage comparator 202*a* as noted to power the timer circuit 248. It should be realized that if a darkened zip code control area 210*a* appears indicating that the zip code is changing, the operation of the machine ceases since the output of the voltage comparator 202*a* remains low and the flip-flop 246 can no longer power the timer circuit 248. To reactivate the machine after the envelopes in the tray 22 are removed, the switch 252 is depressed to pulse the flip-flop 246 and power the timer circuit 248 so tht the card feeder solenoid 198 can be energized to feed the card.

To prevent the accumulation of envelopes in the event of an envelope jamming in the machine, the output of the envelope feed detector 182 is connected to power a thyristor 256 connected to the output of the thyristor 243 between the switch 242 and the envelope feed solenoid 170. When the envelope feed detector switch 182 is closed by the presence of an envelope, the thyristor 256 is powered blocking the output of the thyristor 243 to the envelope feed solenoid so that if an envelope is jammed in the machine, the switch 183 remains closed and another envelope cannot be fed to the envelope feed solenoid. After the switch 183 has opened, of course, the output of the thyristor 243 is fed to the envelope feed solenoid 170 to feed an envelope through the machine 10.

While in the foregoing there has been described a preferred embodiment of the invention, it should be obvious to one skilled in the art that various changes and modifications can be made without departing from the true spirit and scope of the invention as recited in the appended claims.

I claim:

1. A duplicating machine for selectively duplicating printed material from a master card containing information characteristics on one face thereof to a workpiece, said machine comprising a master card feed station including a tray for supporting a stack of master cards and card feed means for feeding a master card from the stack, a workpiece feed station including workpiece feed means for feeding a workpiece therefrom, a print station at which the printed material on a master card is duplicated on a workpiece when said print station receives both a master card and a workpiece, moistening means for applying solvent to said workpiece between said workpiece feed station and said print station, said card feed means and said moistening means being operatively connected to a common drive member whereby said common drive member simultaneously operates said card feed means and moves said moistening means from an inoperative position where it can apply solvent to a workpiece, card reading means including a plurality of sensors operative to provide signals in a circuit and being located in the bottom of said tray whereby the information characteristics on the bottom card in the stack overlie said sensors, said card reading means reading information characteristics on the bottom master card before it is fed to said print station for providing output signals indicating that predetermined information characteristics have or have not been detected, and control means responsive to the signals from said card reading means for operating said drive member and said workpiece feed means if the printed material on said master card is to be duplicated on a workpiece or for operating only said drive member if the printed material is not to be duplicated on a workpiece.

2. A duplicating machine in accordance with claim 1 wherein said moistening means includes a moistening roller for applying solvent to said workpiece and feed roller means, said moistening roller being driven by feed roller means only when a workpiece is fed from said workpiece feed station.

3. A duplicating machine in accordance with claim 2 wherein said feed roller means includes a driven feed roller and a sleeve member carried on said feed roller, said sleeve member being slightly larger than said feed roller whereby said feed roller is rotatable relative to said sleeve member, said moistening roller being adjacent said sleeve member in its operative position whereby said moistening roller and said sleeve member are rotated by said feed roller when a workpiece is fed between the nip of said moistening roller and said sleeve member.

4. A duplicating machine in accordance with claim 1 wherein said duplicating machine further includes mechanical time delay means for adjusting the operation of said common drive member relative to the operation of said workpiece feed means.

5. A duplicating machine in accordance with claim 4 including driver means mechanical time delay means including first clutch means having an inoperative position for disconnecting said common drive member from said driver means and an operative position for connecting said common drive member to said driver means, a trip arm having first position normally retaining said first clutch means in its inoperative position and cam means for moving said trip arm from said first position to a second position wherein said first clutch means moves to its operative position.

6. A duplicating machine in accordance with claim 5 wherein said trip arm is a generally L-shaped member including first and second arm portions, said trip arm being pivoted at the juncture of said first and second arm portions, the free end of said first arm portion being engaged with said first clutch means in said first position, the free end of said second arm portion being located adjacent said cam means, said cam means being rotatably mounted such that said cam means engages said bearing surface pivoting said trip arm to said second position and moving said first arm portion out of engagement with said clutch means.

7. A duplicating machine in accordance with claim 5 wherein said cam means is adjustably mounted relative to said trip arm.

8. A duplicating machine in accordance with claim 7 wherein said cam means is carried on a shaft assembly, said shaft assembly including an outer sleeve portion and an inner shaft portion, a timing gear carried on said outer sleeve portion and a second clutch means having an inoperative position for disconnecting said timing gear from said outer sleeve portion and an operative position for connecting said timing gear to said sleeve portion, solenoid means having a finger portion being located adjacent said second clutch means having a first position in which said finger portion engages said second clutch means and retains said second clutch means in its inoperative position, said solenoid means having a second position in which said finger portion does not engage said second clutch means such that said second clutch means moves to its operative position.

9. A duplicating machine in accordance with claim 8 wherein said cam means is fixed on said inner shaft portion and wherein said inner shaft portion fixedly carries a finger member, said outer sleeve portion carrying a toothed member and said finger member cooperating with said toothed member for retaining said cam means in position and for securing said outer sleeve portion and said inner shaft portion against relative rotation so that said cam means is rotated when said timing gear is connected to said outer sleeve portion.

10. A duplicating machine in accordance with claim 3 wherein said control means includes a first solenoid for controlling the operation of said common drive member and second solenoid means for controlling the operation of said workpiece feed means, said control means energizing said first solenoid if the printed material on a master card is not to be duplicated and energizing said second solenoid if said printed material on a master card is to be duplicated, said control means further including workpiece feed detector means for energizing said first solenoid when said workpiece feed means feeds a workpiece from said workpiece feed station.

11. A duplicating machine for selectively duplicating printed material from a master card containing information characteristics on one face thereof to a workpiece, said machine comprising a master card feed station including a tray for supporting a stack of master cards and card feed means for feeding a master card from the stack, a workpiece feed station incuding workpiece feed means for feeding a workpiece therefrom, a print station at which the printed material on a master card is duplicated on a workpiece when said print station receives both a master card and a workpiece, card reading means including a plurality of sensors operative to provide signals in a circuit and being located in the bottom of said tray whereby the information characteristics on the bottom card in the stack overlie said sensors, said card reading means reading information characteristics on the bottom master card before it is fed to said print station, said card reading means providing a first signal if predetermined information characteristics are detected and a second signal if predetermined information characteristics are not detected, control means responsive to said first and second signals for energizing a first solenoid if said printed material is to be duplicated or for energizing a second solenoid if said printed material is not to be duplicated, said first solenoid being operatively associated with said workpiece feed means and said second solenoid being associated with said master card feed means, workpiece feed detector means for energizing said second solenoid when said workpiece feed means feeds a workpiece from said workpiece feed station, and mechanical adjustment means interposed between said second solenoid and said card feed means whereby the location of the printed material on a master card can be adjusted relative to the workpiece when a master card and a workpiece are received at said print station.

12. A duplicating machine in accordance with claim 11 wherein said control means includes inverter switch means so that said printed material on said master card can be selectively duplicated when predetermined information is or is not detected on said master card.

13. A duplicating machine in accordance with claim 12 wherein said control means includes card detection means for determining when a master card is present and at rest in said card feed station and for providing an enabling signal which allows said first or second signal from said card reader means to energize the appropriate one of said solenoids.

14. A duplicating machine in accordance with claim 13 wherein said card detection means feeds said enabling signal to a flip-flop and wherein said flip-flop powers a timer circuit which receives the first and second signals when not powered and which allows said first and second signals to energize the appropriate one of said solenoids when it is powered.

15. A duplicating machine in accordance with claim 14 wherein said flip-flop is connected to said first solenoid through a selector switch means whereby said flip-flop can control said first solenoid when it is desired to duplicate the printed material on each card in said master card feed station.

16. A duplicating machine in accordance with claim 15 wherein the enabling signal can be reinforced by an external voltage source through a switch means before it is fed to said flip-flop, and wherein the enabling signal can be depressed by a switch means connected to the ground.

17. A duplicating machine in accordance with claim 11 including means for blocking the signal to the first solenoid when said workpiece feed detector means detects a workpiece has jammed in said machine.

18. A duplicating machine for selectively duplicating printed material from a master card to a workpiece, said machine comprising a master card feed station including card feed means for feeding a master card therefrom, a workpiece feed station including a workpiece feed means for feeding a workpiece therefrom, a print station at which the printed material on a master card is duplicated on a workpiece when said print station receives both a master card and a workpiece, moistening means for applying solvent to said workpiece between said workpiece feed station and said print station, said card feed means and said moistening means being operatively connected to a common drive member whereby said common drive member simultaneously operates said card feed means and moves said moistening means from an inoperative position to an operative position where it can apply solvent to a workpiece, card reading means at said master card feed station for reading information characteristics on a master card before it is fed to said print station and for providing output signals indicating that predetermined characteristics have or have not been detected, and control means responsive to the signals from said card reading means for operating said drive member and said workpiece feed means if the printed material on said master card is to be duplicated on a workpiece or for operating only said drive member if the printed material is not to be duplicated on said workpiece, said moistening means including a moistening roller for applying solvent to said workpiece and feed roller means, said moistening roller being driven by feed roller means only when a workpiece is fed from said workpiece feed station, said feed roller means including a driven feed roller and a sleeve member carried on said feed roller, said sleeve member being slightly larger than said feed roller whereby said feed roller is rotatable relative to said sleeve member, said moistening roller being adjacent said sleeve member in its operative position whereby said moistening roller and said sleeve member are rotated by said feed roller when a workpiece is fed between the nip of said moistening roller and said sleeve member.

19. A duplicating machine in accordance with claim 18 wherein said control means includes a first solenoid for controlling the operation of said common drive member and second solenoid means for controlling the operation of said workpiece feed means, said control means energizing said first solenoid if the printed material on a master card is not to be duplicated and energizing said second solenoid if said printed material on a master card is to be duplicated, said control means further including workpiece feed detector means for energizing said first solenoid when said workpiece feed means feeds a workpiece from said workpiece feed station.

20. A duplicating machine for selectively duplicating printed material from a master card to a workpiece, said machine comprising a master card feed station including card feed means for feeding a master card therefrom, a workpiece feed station including workpiece feed means for feeding a workpiece therefrom, a print station at which the printed material on a master card is duplicated on a workpiece when said print station receives both a master card and a workpiece, moistening means for applying solvent to said workpiece between said workpiece feed station and said print station, said card feed means and said moistening means being operatively connected to a common drive member whereby said common drive member simultaneously operates said card feed means and moves said moistening means from an inoperative position to an operative position where it can apply solvent to a workpiece, card reading means at said master card feed station for reading information characteristics on a master card before it is fed to said print station and for providing output signals indicating that predetermined information characteristics have or have not been detected, and control means responsive to the signals from said card reading means for operating said drive member and said workpiece feed means if the printed material on said master card is to be duplicated on a workpiece or for operating only said drive member if the printed material is not to be duplicated on said workpiece, said duplicating machine further including mechanical time delay means for adjusting the operation of said common drive member relative to the operation of said workpiece feed means, said mechanical time delay means including first clutch means having an inoperative position for disconnecting said common drive member from driver means and an operative position for connecting said common drive member to said driver means, a trip arm having first position normally retaining said first clutch means in its inoperative position and cam means for moving said trip arm from said first position to a second position wherein said first clutch means moves to its operative position.

21. A duplicating machine in accordance with claim 20 wherein said trip arm is a generally L-shaped member including first and second arm portions, said trip arm being pivoted at the juncture of said first and second arm portions, the free end of said first arm portion being engaged with said first clutch means in said first position, the free end of said second arm portion being located adjacent said cam means, said cam means being rotatably mounted such that said cam means engages said bearing surface pivoting said trip arm to said second position and moving said first arm portion out of engagement with said clutch means.

22. A duplicating machine in accordance with claim 20 wherein said cam means is adjustably mounted relative to said trip arm.

23. A duplicating machine in accordance with claim 22 wherein said cam means is carried on a shaft assembly, said shaft assembly including an outer sleeve portion and an inner shaft portion, a timing gear carried on said outer sleeve portion and a second clutch means having an inoperative position for disconnecting said timing gear from outer sleeve portion and an operative position for connecting said timing gear to said sleeve portion, solenoid means having a finger portion being located adjacent said second clutch means and having a first position in which said finger portion engages said second clutch means and retains said second clutch means in its operative position, said solenoid means having a second position in which said finger portion does not engage said second clutch means such that said second clutch means moves to its operative position.

24. A duplicating machine in accordance with claim 23 wherein said cam means is fixed on said inner shaft portion and wherein said inner shaft portion fixedly carries a finger member, said outer sleeve portion carrying a toothed member and said finger member cooperating with said toothed member for retaining said cam means in position and for securing said outer sleeve portion and said inner shaft portion against relative rotation so that said cam means is rotated when said timing gear is connected to said outer sleeve portion.

25. A duplicating machine for selectively duplicating printed material from a master card to a workpiece, said machine comprising a master card feed station including card feed means for feeding a master card therefrom, a workpiece feed station including workpiece feed means for feeding a workpiece therefrom, a print station at which the printed material on a master card is duplicated on a workpiece when said print station receives both a master card and a workpiece, card reading means at said master card feed station for reading information characteristics on a master card before it is fed to said print station, said card reading means providing a first signal if predetermined information characteristics are detected and a second signal if predetermined information characteristics are not detected, control means responsive to said first and second signals for energizing a first solenoid if said printed material is to be duplicated or for energizing a second solenoid if said printed material is not to be duplicated, said first solenoid being operatively associated with said workpiece feed means and said second solenoid being associated with said master card feed means, workpiece feed detector means for energizing said second solenoid when said workpiece feed means feeds a workpiece from said workpiece feed station, and mechanical adjustment means interposed between said second solenoid and said card feed means whereby the location of the printed material on a master card can be adjusted relative to the workpiece when a master card and a workpiece are received at said print station, said control means including inverter switch means so that said printed material on said master card can be selectively duplicated when predetermined information is or is not detected on said master card, said control means including card detection means for determining when a master card is present and at rest in said card feed station and for providing an enabling signal which allows said first or second signal from said card reader means to energize the appropriate one of said solenoids.

26. A duplicating machine in accordance with claim 25 wherein said flip-flop is connected to said first solenoid through a selector switch means whereby said flip-flop can control said first solenoid when it is desired to duplicate the printed material on each card in said master card feed station.

27. A duplicating machine in accordance with claim 26 wherein the enabling signal can be reinforced by an external voltage source through a switch means before it is fed to said flip-flop, and wherein the enabling signal can be depressed by a switch means connected to ground.

28. A duplicating machine for selectively duplicating printed material from a master card to a workpiece, said machine comprising a master card feed station including card feed means for feeding a master card therefrom, a workpiece feed station including workpiece feed means for feeding a workpiece therefrom, a print station at which the printed material on a master card is duplicated on a workpiece when said print station receives both a master card and a workpiece, card reading means at said master card feed station for reading information characteristics on a master card before it is fed to said print station, said card reading means providing a first signal if predetermined information characteristics are detected and a second signal if predetermined information characteristics are not detected, control means responsive to said first and second signals for energizing a first solenoid if said printed material is to be duplicated or for energizing a second solenoid if said printed material is not to be duplicated, said first solenoid being operatively associated with said workpiece feed means and said second solenoid being associated with said master card feed means, workpiece feed detector means for energizing said second solenoid when said workpiece feed means feeds a workpiece from said workpiece feed station, and mechanical adjustment means interposed between said second solenoid and said card feed means whereby the location of the printed material on a master card can be adjusted relative to the workpiece when a master card and a workpiece are received at said print station, means for blocking the signal to the first solenoid when said workpiece feed detector means detects a workpiece has jammed in said machine.

* * * * *